US006402232B1

(12) United States Patent
Tsai

(10) Patent No.: US 6,402,232 B1
(45) Date of Patent: Jun. 11, 2002

(54) CHAIR WITH ADJUSTABLE BACKREST AND FOOTREST

(76) Inventor: Sung-Tsun Tsai, No. 908, Nan-Pin Road, West-Castle Village, Ta-Cheng Hsiang, Changhua Country (TW)

( * ) Notice: Subject to any disclaimer, the term of this patent is extended or adjusted under 35 U.S.C. 154(b) by 0 days.

(21) Appl. No.: 09/678,390

(22) Filed: Oct. 3, 2000

(51) Int. Cl.[7] ..... A47C 1/02
(52) U.S. Cl. ..... 297/68; 297/83
(58) Field of Search ..... 297/68, 71, 73, 297/75, 69, 83, 423.19, 354.1, 358

(56) References Cited

U.S. PATENT DOCUMENTS 1,024,966 A * 4/1912 Baber ..... 297/68
3,142,509 A * 7/1964 Ehrke et al. ..... 297/71
3,858,938 A * 1/1975 Kristensson et al. ..... 297/68 X
4,792,181 A * 12/1988 Guichon ..... 297/68 X
5,007,679 A * 4/1991 Mizelle ..... 297/68 X
5,082,324 A * 1/1992 Harada et al. ..... 297/83
5,348,367 A * 9/1994 Mizelle ..... 297/83

* cited by examiner

*Primary Examiner*—Peter M. Cuomo
*Assistant Examiner*—Stephen Vu
(74) *Attorney, Agent, or Firm*—Rosenberg, Klein & Lee

(57) ABSTRACT

A chair includes a seat portion with legs and a backrest frame and a footrest are respectively pivotally connected to two opposite ends of the seat portion. Two rods are pivotally connected between the backrest and the footrest. A cylinder is connected to an underside of the seat portion and a piston rod of the cylinder is connected to an end of the backrest. A control lever is connected to the cylinder and controls the movement of the piston rod of the cylinder to pivot the backrest and the footrest.

3 Claims, 4 Drawing Sheets

CHAIR WITH ADJUSTABLE BACKREST AND FOOTREST

FIELD OF THE INVENTION

The present invention relates to a leisure chair wherein a backrest and a footrest are connected with each other by two rods and respectively pivotally connected to the seat portion so that the backrest and the footrest are correspondingly adjustable.

BACKGROUND OF THE INVENTION

A conventional leisure chair generally includes a seat portion and a backrest which is pivotally connected to a frame of the seat portion. A ratchet mechanism is connected between the seat portion and the backrest so that when operating the ratchet mechanism, the backrest can be pivoted relative to the seat portion. However, the backrest of the conventional leisure chain has to be pivoted toward the seat portion to an extreme position then the backrest can be fixed at a desired position. This action is so large and requires a lot of effort so that some users could not able to operate it. Furthermore, the positions that the backrest is positioned generally are five and because the backrest is positioned during the release travel so that the user could miss the desired position. If so, the user has to press the backrest toward the seat portion again and to let the backrest travel the backward again to carefully let the ratchet mechanism be engaged with the backrest. It is experienced that the users usually repeatedly fold the backrest again and again to position the backrest at the desired position.

The present invention intends to provide a leisure chair which employs a cylinder to pivot the backrest. A footrest is linked to the backrest so that both of which are adjustable by one action.

SUMMARY OF THE INVENTION

In accordance with one aspect of the present invention, there is provided a leisure chair and comprising a seat portion with legs connected thereto. A backrest frame has a first bar connected between two sides of the backrest frame, and the first bar is pivotally connected to a first end of the seat portion. A second bar is connected between a first end of the backrest frame and the first bar. A footrest frame has an end pivotally connected to a second end of the seat portion, and a third bar is connected between two sides of the footrest frame. Two rods are pivotally connected between the third bar and the first end of the backrest frame. A cylinder is connected to the seat portion and a piston rod of the cylinder is pivotally connected to the second bar. A control lever is connected to the cylinder to control the cylinder to push or pull the backrest.

The primary object of the present invention is to provide a chair structure that has a backrest and a footrest wherein both of which are pivoted by operating a control lever to actuate a cylinder.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
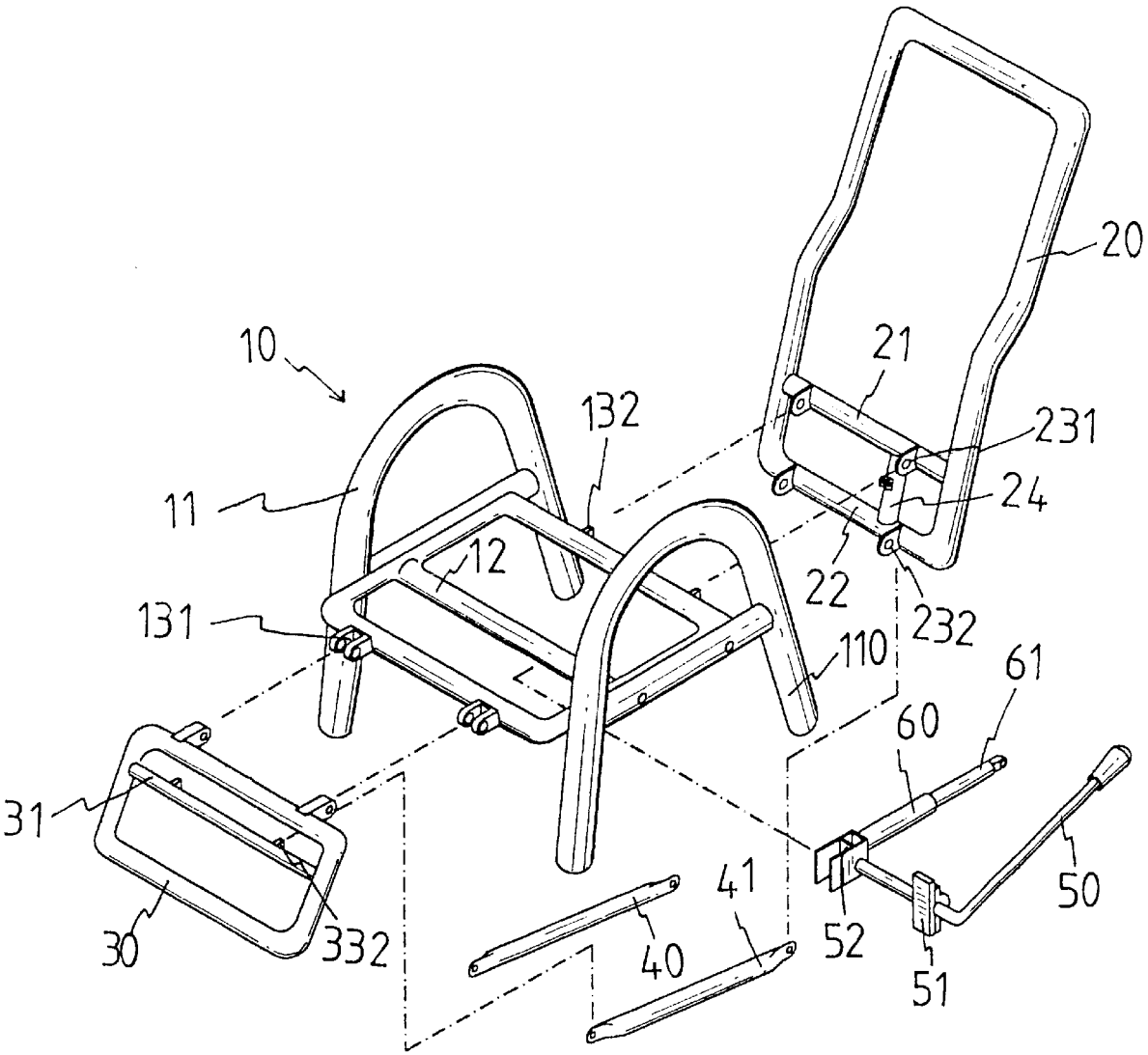
FIG. 1 is an exploded view to show a chair of the present invention.
Figure 2:
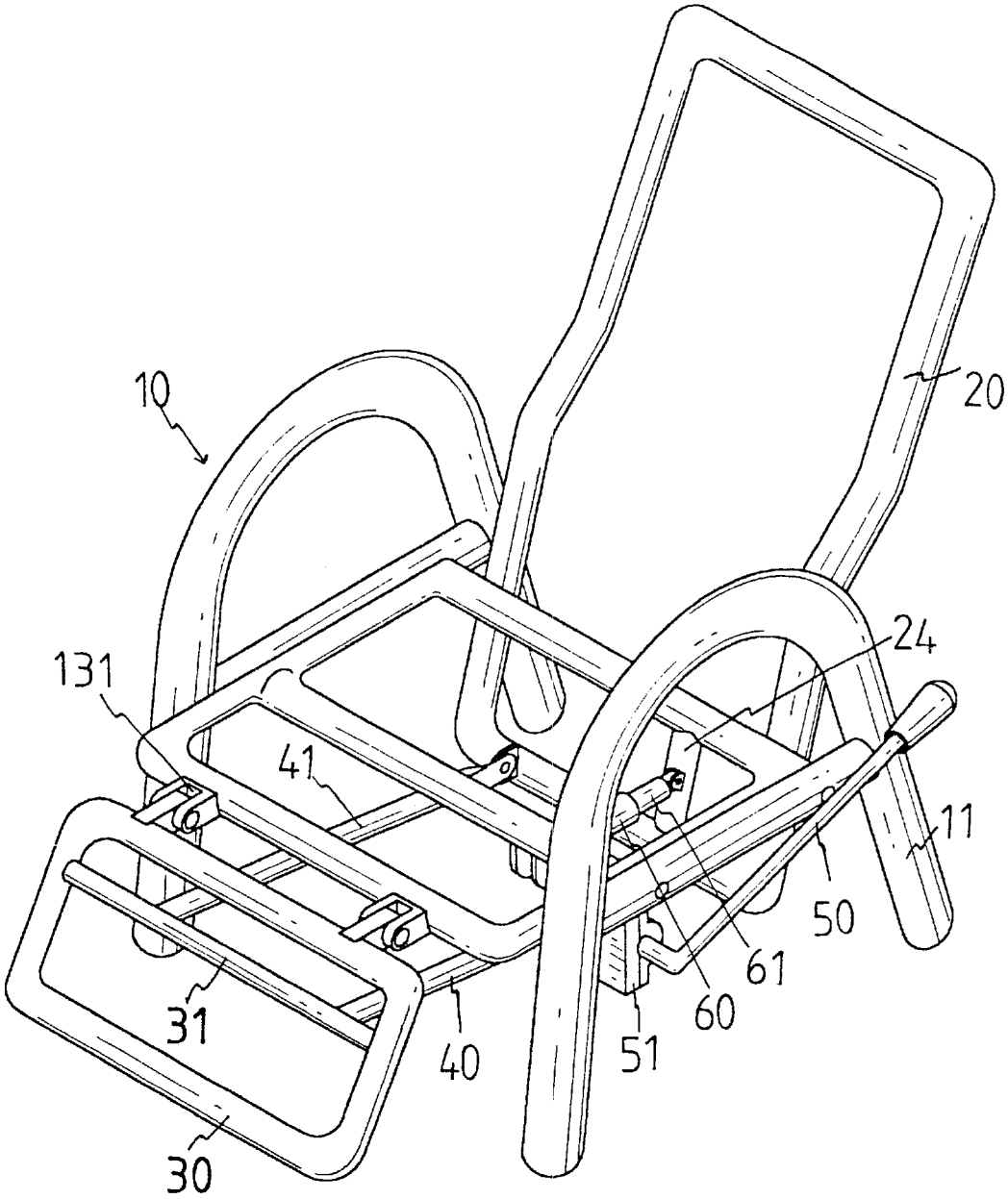
FIG. 2 is a perspective view to show the chair of the present invention.

Referring to FIGS. 1 and 2, the leisure chair of the present invention comprises a seat portion 10 with two armrests 11 and four legs 110 connected thereto. A first end of the seat portion 10 has two lugs 132 and a second end of the seat portion 10 has two lugs 131. A medium bar 12 is connected between two sides of the seat portion 10. A control lever 50 and a cylinder 60 are connected to the medium bar 12.

A backrest frame 20 has a first bar 21 connected between two sides of the backrest frame 20. The first bar 21 has two lugs 231 which are pivotally connected to the lugs 132 on the first end of the seat portion 10. A second bar 24 is connected between a first end 22 of the backrest frame 20 and the first bar 21. Two lugs 232 are connected to the first end 22. A footrest frame 30 has two lugs 313 on an end thereof and the two lugs 313 are pivotally connected to the lugs 131 on the second end of the seat portion 10. A third bar 31 is connected between two sides of the footrest frame 30 and two lugs 332 are connected to the third bar 31. Two rods 40, 41 are pivotally connected between the lugs 332 on the third bar 31 and the lugs 232 on the first end 22 of the backrest frame 20.

Figure 3:
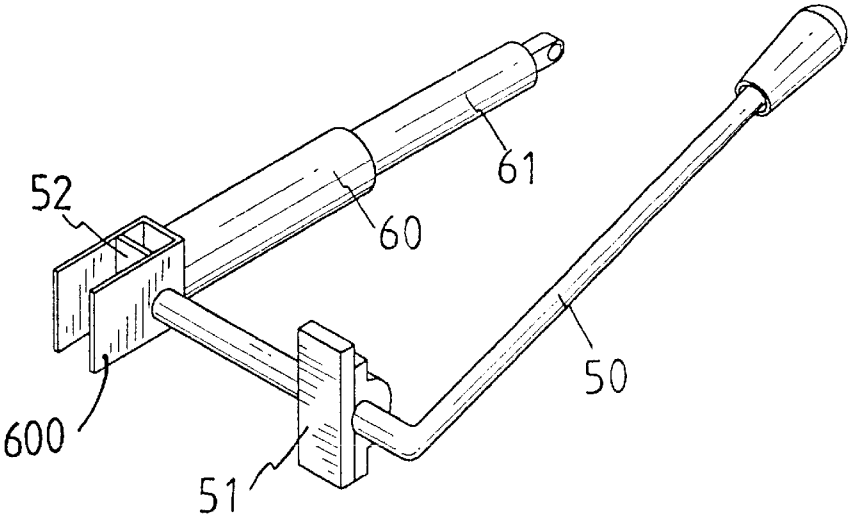
FIG. 3 is a perspective view to show a cylinder and a control lever connected to the cylinder.

Referring to FIG. 3, the cylinder 60 has a piston rod 61 retractably received in the cylinder 60 and the piston rod 61 is pivotally connected to a lug on the second bar 24. The control lever 50 is an L-shaped lever and an end of the control lever 50 rotatably extends through a connection member 51 which is connected to the medium bar 12. Two plates 600 extend from the cylinder 60 and a switch 62 is located on an end of the cylinder 60. The switch 62 is located between the two plates 600. An end of the control lever 50 extends through the two plates 600 and a press member 52 is connected to the end of the control lever 50. A spring 63 is mounted to the switch 62 and connected to the press member 52 so as to separate the switch 62 and the press member 52 when the control lever 50 is not operated.

Figure 4:
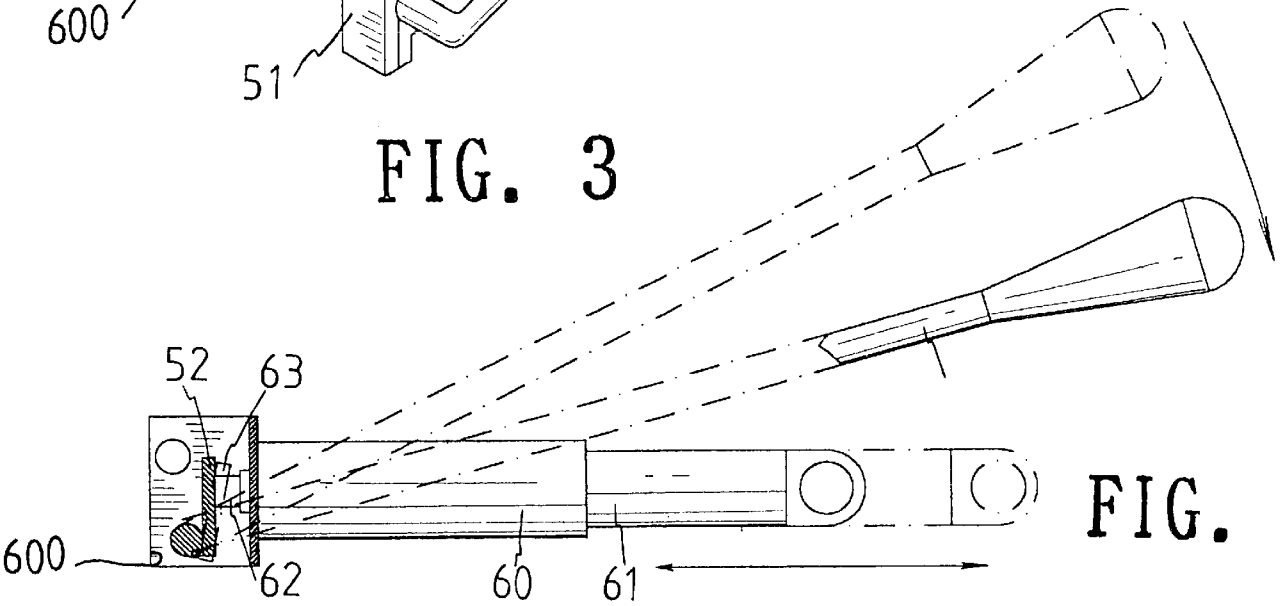
FIG. 4 is an illustrative view to show a switch of the cylinder is pressed by operating control lever.
Figure 5:
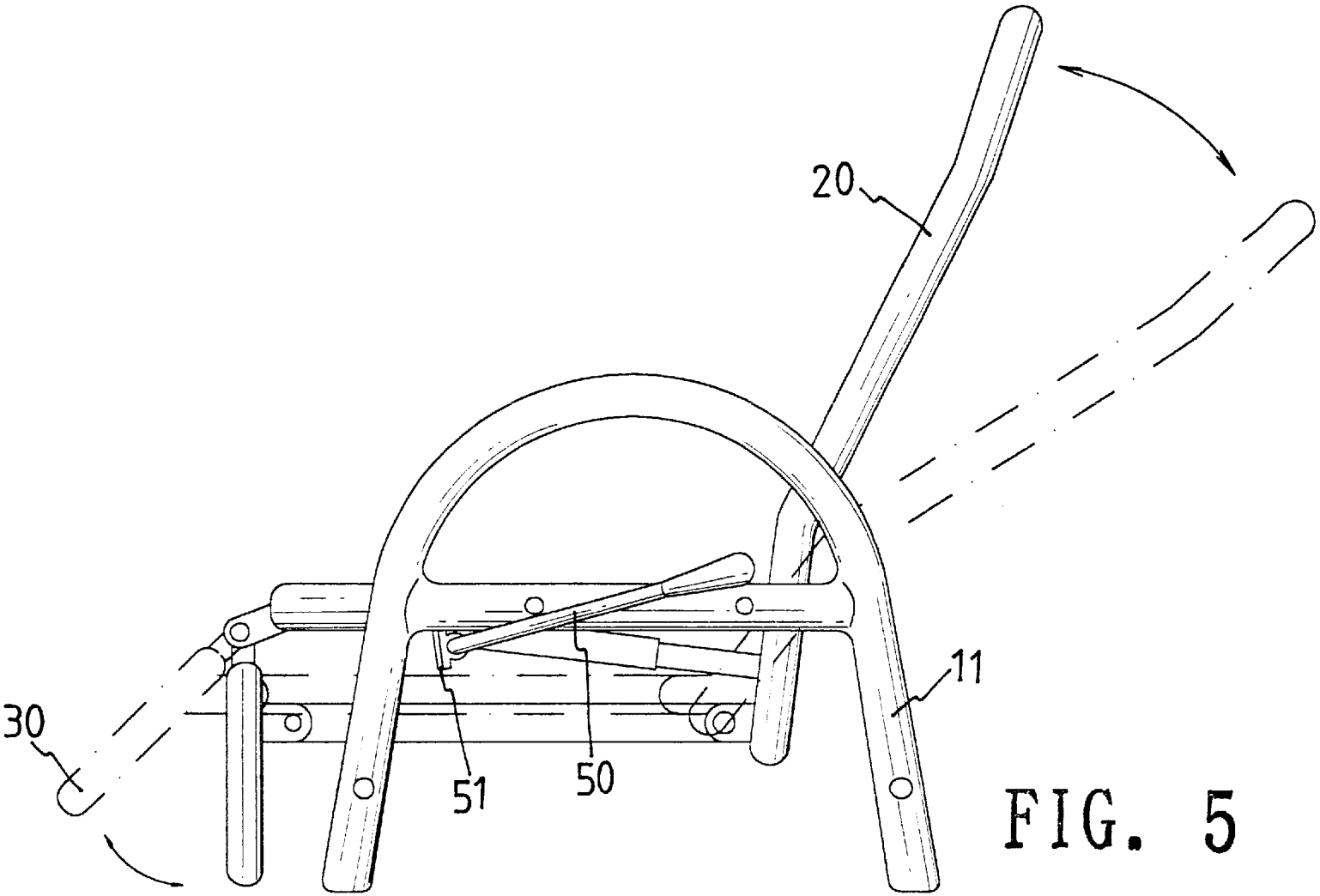
FIG. 5 is an illustrative view to show both of the backrest and the footrest are pivoted simultaneously.

Referring to FIGS. 4 and 5, when rotating the end of the control lever 50, the press member 52 presses the spring 63 and contacts the switch 62 to let the piston rod 61 retracted so that the backrest frame 20 is pivoted about the connections of the two pairs of lugs 231 on the first bar 21 and the first end of the seat portion 10. When the control lever 50 is released, the spring 63 push the press member 52 away from the switch 62 so that the backrest frame 20 is positioned at the position. Because the backrest frame 20 and the footrest 30 are connected by rods 40, 41, so that when the backrest frame 20 is pivoted, the footrest 30 is pivoted simultaneously so let the footrest 30 be positioned at a suitable position with respect to the position of the backrest frame 20.

While we have shown and described various embodiments in accordance with the present invention, it should be clear to those skilled in the art that further embodiments may be made without departing from the scope and spirit of the present invention.

What is claimed is:

1. A chair comprising:

a seat portion with legs connected thereto;

a backrest frame having a first bar connected between two sides of the backrest frame, said first bar pivotally connected to a first end of said seat portion, a second bar connected between a first end of said backrest frame and said first bar;

a footrest frame having an end pivotally connected to a second end of said seat portion, a third bar connected between two sides of said footrest frame;

two rods pivotally connected between said third bar and said first end of said backrest frame, and a cylinder connected to said seat portion and a piston rod of said cylinder pivotally connected to said second bar, two plates extending from said cylinder and a switch located on an end of said cylinder, said switch located between said two plates, an L-shaped control lever having an end thereof extending through said two plates and a press member connected to said end of said control lever, a spring mounted to said switch and connected to said press member so as to separate said switch and said press member.

2. The chair as claimed in claim 1 wherein said end of said control lever is connected to an end of said press member so that when rotating said end of said control lever, said press member presses said spring and contacts said switch.

3. The chair as claimed in claim 1 further comprising a connection member connected to said seat portion and said control lever rotatably extending through said connection member.

* * * * *